US005570649A

United States Patent [19]

Austin

[11] Patent Number: 5,570,649

[45] Date of Patent: Nov. 5, 1996

[54] BOAT HULL

[76] Inventor: Lee Austin, 231 SW. 21st Terrace, Ft. Lauderdale, Fla. 33312

[21] Appl. No.: 489,849

[22] Filed: Jun. 13, 1995

[51] Int. Cl.[6] ..... B63B 1/00

[52] U.S. Cl. ..... 114/61; 114/292

[58] Field of Search ..... 114/271, 274, 114/288, 289, 290, 292, 56, 57, 61, 123

[56] References Cited

U.S. PATENT DOCUMENTS

| | | | |
|---|---|---|---|
| 3,191,572 | 6/1965 | Wilson . | |
| 3,208,421 | 9/1965 | Landes et al. | 114/292 |
| 3,470,839 | 10/1969 | Faul et al. | 114/61 |
| 3,791,329 | 2/1974 | Bruning | 114/61 |
| 3,937,164 | 2/1976 | Austin . | |
| 4,091,761 | 5/1978 | Fehn | 114/61 |
| 4,356,787 | 11/1982 | Harley et al. | 114/292 |
| 4,478,166 | 10/1984 | Sorensen . | |
| 4,644,890 | 2/1987 | Lott | 114/61 |
| 4,722,294 | 2/1988 | Bruning . | |
| 4,907,520 | 3/1990 | Pipkorn . | |
| 5,016,552 | 5/1991 | Ludlow . | |

*Primary Examiner*—Stephen Avila
*Attorney, Agent, or Firm*—Olson & Hierl, Ltd.

[57] ABSTRACT

A boat hull structure comprising a pair of laterally-spaced hulls having V-shaped bottom portions that are each symmetrical about a vertical plane extending through its longitudinal axis. A channel defined in each bottom portion that extends substantially along the length of each hull for trapping air and water to provide lift and to reduce "stuffing". Each channel defined by a pair of spaced, parallel and vertical channel walls and a horizontal base that interconnects the channel walls. A pair of strikes defined on each bottom portion that straddles the channel to define a high speed planing surface. The strikes preferably are located at the same elevation as the base of the channel so that the boat can plane on the strikes and the base of the channel at the same time. With this construction, the planing surface area of the boat hull structure is reduced, which enhances the speed performance of the boat hull structure.

22 Claims, 3 Drawing Sheets

BOAT HULL

FIELD OF THE INVENTION

The present invention relates to a hull for a boat.

BACKGROUND OF THE INVENTION

Two important and sometimes conflicting considerations in designing hulls for boats intended to be used at high speeds are water planing performance and stability. Higher planing performance usually can be achieved by minimizing the planing or wetted surface area of the hull since this surface area creates "drag", which tends to reduce the speed of the boat. On the other hand, boat hulls with reduced planing surface areas are often unstable and very difficult to handle, especially at high speeds and in rough waters.

One form of measurement used in designing hulls is called "deadrise" which represents the upward angle at which the bottom surface of the hull extends relative to a completely horizontal plane extending through the bottom of the boat. A hull with a steep deadrise has more planing surface area and, thus, more drag than a hull with less deadrise. Accordingly, a hull with a steep deadrise tends to be easier to handle, but requires more power, than a boat with less deadrise.

The most popular boat hull designs are "vee hulls", which have generally triangular cross sections, and "catamaran hulls" or "cat hulls", which comprise a pair of bottom hulls that are interconnected by a bridging structure. Each bottom hull of a catamaran hull has a flat bottom that extends at a downward incline relative to the other hull. The deadrise of vee hulls is usually in the range of 20 to 25 degrees and the deadrise of catamaran hulls is usually in the range of 12 to 15 degrees. Accordingly, boats having vee hulls tend to have lower speed performance but are easier to handle at high speeds than boats having catamaran hulls.

Vee hulls and catamaran hulls usually are constructed with pairs of laterally-extending "strikes" or "chines" which provide planing surfaces on which the hulls plane or ride when the boat achieves a certain speed. The strikes are intended to reduce the planing surface of the hull, which enhances the speed performance of the hull.

At the same time, however, the strikes reduce the planing stance of the hull, which makes the boats less manageable, especially in rough waters. Additionally, vee hulls often experience "chine walking", which occurs when the boat rocks back and forth on its strikes as a result of the reduced planing surface area provided by the strikes.

Catamaran hulls, on the other hand, are less likely to experience chine walking because they have a wider planing stance than vee hulls since there are two hulls. Moreover, since catamaran hulls have less deadrise than vee hulls, catamaran hulls usually are able to achieve higher speeds at relatively low power.

At the same time, however, the catamarans can be difficult to handle in rough waters because of the deadrise. Catamarans also often experience "stuffing" in rough waters which is when the bow of the hull digs into the water during travel. Stuffing is a dangerous condition that can cause the boat to capsize.

What is needed is a hull for a boat that makes the boat more manageable at high speeds than the prior art hulls. Such a hull should have a reduced planing surface and also a wide planing stance to reduce the possibility of chine walk and enhance the handling of the boat. Such a hull should also have a steeper deadrise than that of conventional vee hulls and catamaran hulls. The present invention meets these desires.

SUMMARY

The present invention relates to a boat hull structure that includes a pair of laterally-spaced, interconnected hulls. Each hull has a bottom portion that has a generally V-shaped cross section substantially along its length and that is generally symmetrical about a vertical plane extending through its longitudinal axis.

In the preferred embodiment, each bottom portion includes a pair of upwardly-extending walls and a base that extends substantially along the length of the hull to define a channel. The base interconnects the top or upper ends of the walls so that the cross section of the channel is generally rectangular. Air and water are forced within the channel, which provides lift to the boat hull structure when it is moving.

Each bottom portion also includes a pair or strikes that extends along at least most of the length of the hull and that is disposed about the channel. The strikes define high speed planing surfaces. In the preferred embodiment, the planing surfaces are generally horizontal and are located at about the same elevation as the base along at least most of the length of the hull so that the boat can plane on the strikes and the bases at the same time. With this construction, the planing surface area of the boat hull structure is reduced, which enhances the speed performance of the hull.

If desired, upward of the strikes, each bottom portion may include another pair of strikes that define another pair of generally horizontal planing surfaces on which the boat can plane. These other strikes also have a compression effect on the water and the air at the bow of the boat, which forces the bow of the boat upwards during travel at lower speeds.

Accordingly, the invention provides a boat hull structure having less planing surface and a wider planing stance than conventional cat hulls and vee hulls. As a result, the boat hull structure is more manageable at high speeds and in rough waters than the conventional cat hulls and vee hulls.

The boat hull structure in accordance with the present invention also enables the boat to ride on the water much higher than the prior art boats. And, since the bases of the channels are aligned with one of the pairs of strikes, water and air are compressed within the channel, which provides lift to enable the boat to step onto its strikes faster than prior art designs. Since the channel extends substantially along the length of the boat, a compression effect also occurs at the bow of the boat which reduces the possibility of stuffing.

The boat performs at high speeds equal to or above that of other boats with the use of less horsepower, and also performs well at high and low speed in virtually all sea conditions.

BRIEF DESCRIPTION OF THE DRAWINGS

The present invention and the advantages thereof will become more apparent upon consideration of the following detailed description when taken in conjunction with the accompanying drawings.

DESCRIPTION OF THE PREFERRED EMBODIMENTS

Figure 1:
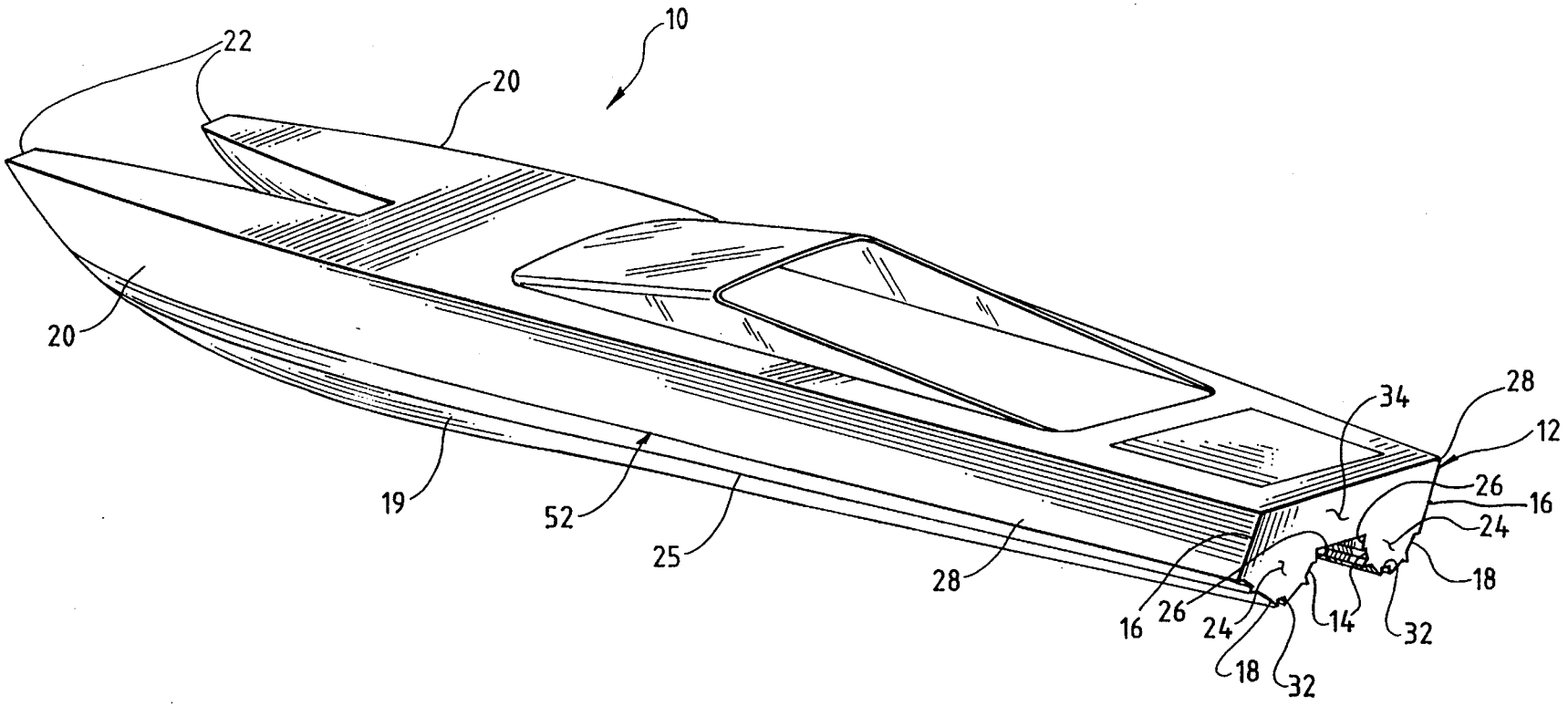
FIG. 1 is a perspective view of a boat having a boat hull structure in accordance with a preferred embodiment of the invention.

Referring to FIGS. 1–4, the present invention relates to a boat 10 having a boat hull structure 12 that, in accordance with the preferred embodiment of the invention, includes a pair of laterally-spaced hulls 14. The example given for the boat 10 shown in the FIGURES is a power boat, but for ease of discussion, the propellers and rudders are not shown.

Each hull 14 has a top portion 16, and a bottom portion 18 that defines a pair of hull walls 19. The bottom portion has a generally V-shaped cross section substantially along its length and is generally symmetrical about a vertical plane extending through its longitudinal axis. Each hull 14 includes a bow 20 having a front end 22, a stern 24, inner and outer side walls 26, 28 extending generally upward from the hull walls 19, and a pair of first strikes 25 defined on the hull walls that extend along at least most of the length of the bottom portion.

A pair of channel walls 30 are defined in the bottom portion 18 of each hull 14 that preferably are generally vertical and extend upward substantially along the length of the hull to define a channel 32 in the bottom portion into which air and water are forced to provide lift when the boat 10 is moving.

In the preferred embodiment, the walls 30 of each channel 32 are spaced and parallel and the top or upper ends of the walls are interconnected by a base 38 that also extends substantially along the length of the hull 14. The walls and base of each hull 14 define an inverted U-shaped configuration that extends along the bottom portion 18 (see, e.g. FIGS. 2 and 3).

Figure 2:
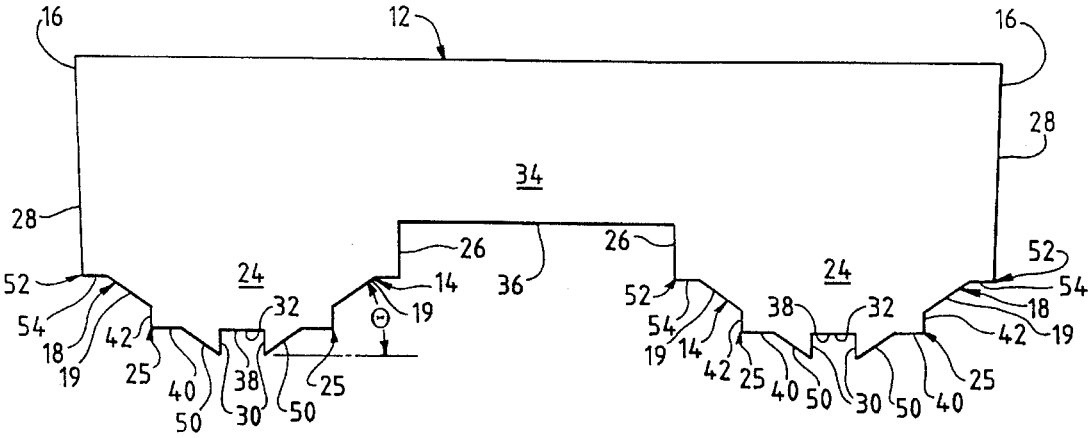
FIG. 2 is a rear plan view of the of the boat hull structure of FIG. 1.

Preferably, the base 38 is generally horizontal and the walls 30 and base 38 are substantially flat so that the channel 32 has a rectangular cross section substantially along its length. The width and depth of the channel 32 preferably are constant substantially along the length of the channel. The cross sections of the walls 30, base 38 and channel 32 are illustrated in FIG. 2, which is a rear plan view of the boat hull structure 12 (but is also representative of a cross section view along most of the length of the boat hull structure).

The channel 32 on each hull 14 is disposed between the pair of first strikes 25, each of which defines a first generally horizontal planing surface 40 and a first generally vertical surface 42. The planing surfaces 40 and vertical surfaces 42 are substantially flat along most of the length of the hull 14.

In the preferred embodiment, the bases 38 substantially align with the first horizontal planing surfaces 40 substantially along the length of the bottom portions 18 so that the boat 10, when traveling at high speeds, can plane on the first pair of strikes 25 (i.e. the first horizontal planing surfaces) and the bases 38 at the same time to enhance the speed performance of the boat.

Figure 3:
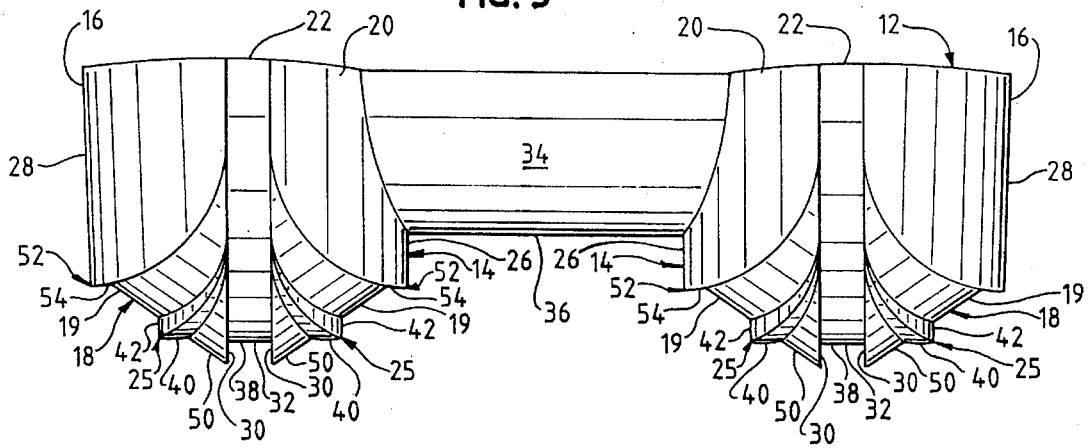
FIG. 3 is a front plan view of the boat hull structure of FIGS. 1–2.
Figure 4:
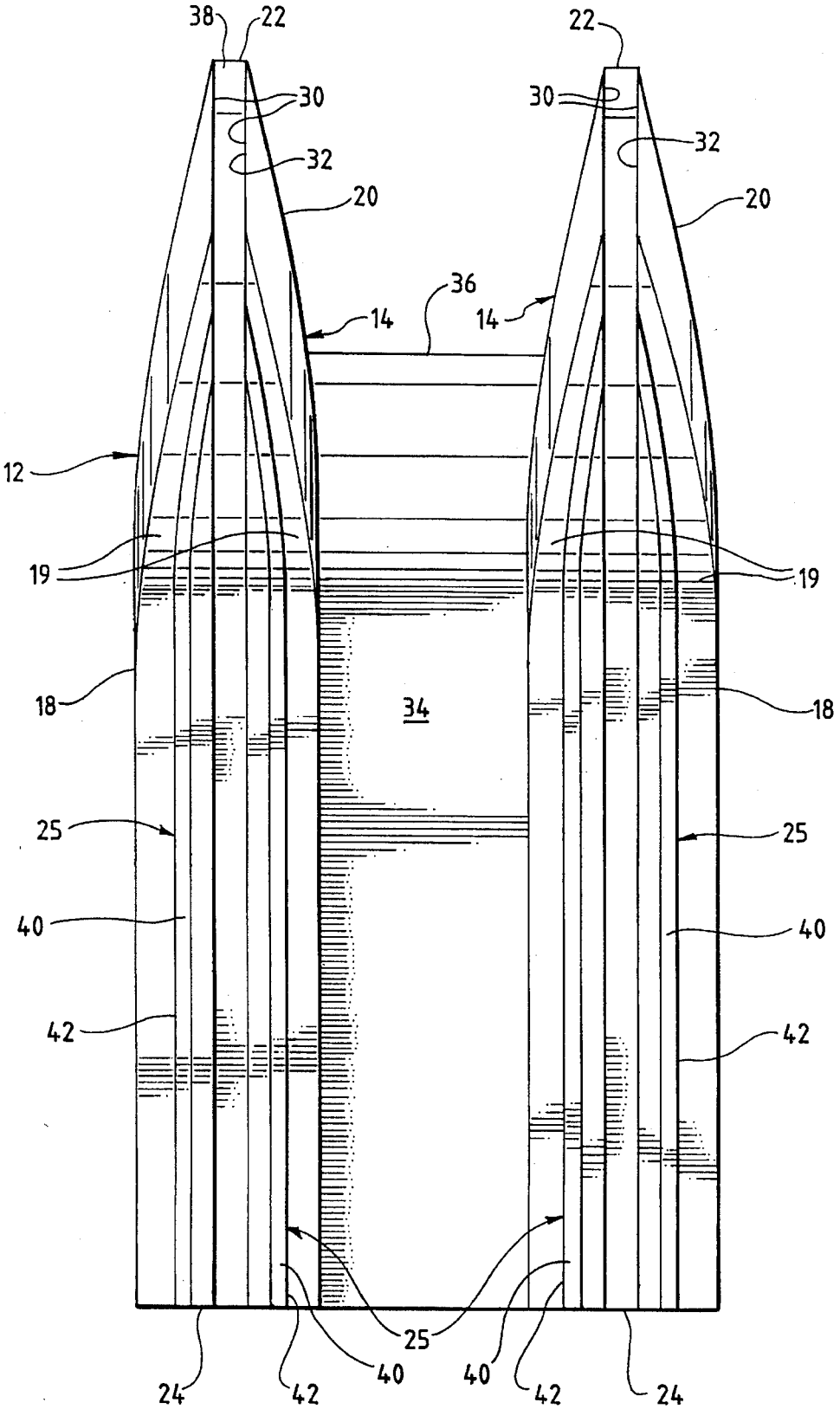
FIG. 4 is a bottom plan view of the boat hull structure of FIGS. 1–3.

In the preferred embodiment, the channel 32 extends the entire length of the hull 14; and the first strikes 25 extend from the stern 24 and along the upwardly-curved and narrowing bow 20 of the hull 14, and terminate rearward of the front end 22 of the bow of the boat 10 at the walls 30 that define the channel (see FIGS. 3 and 4). The bases 38 and the walls 30 and the horizontal planing surfaces 40 of the first strikes 25 tend to compress water and air underneath the hulls 14 which forces the bow 20 upwards during travel. As a result, this construction provides better lift and enables the boat to step onto its first strikes 25 faster than prior art designs. Since the compression effect can also occur at the bow, this design also reduces the possibility of stuffing.

A pair of V-shaped protrusions 50 are defined on each hull 14 by the walls 30 and the sections of the hull walls 19 that extend from the first strikes 25 to the walls 30. The V-shaped protrusions act as keels to enhance the stability of the boat 10.

The hulls 14 are joined together by a bridging structure 34 that extends from the stern 24 toward the bow 20 and terminates rearward of the front end 22 of the bow. The bridging structure 34 and the inner side walls 26 of the hulls 14 define a central passage 36 disposed between the hulls along the length of the bridging structure. The front of the bridging structure 34 may be rounded to enhance the stability of the boat (see FIG. 3).

If desired, each hull 14 may also include a pair of second strikes 52 to define a pair of second generally horizontal planing surfaces 54 on which the boat 10 can ride when traveling at low speeds. The second strikes are defined at the top of the hull walls 19 and the bottom of the inner and outer walls 26, 28, and are disposed about the channel 32 upward of the pair of first strikes 25. The second strikes 52 preferably also extend from the stern of the hulls 14 and along the upwardly-curved and narrowing bow 20, and terminate rearward of the front end 22 of the bow of the boat at the walls 30 that define the channel 32 (see FIG. 3). The second strikes 52 also have a compression effect on the water and the air at the bow of the boat 10, which forces the bow 20 of the boat upwards during travel at lower speeds.

Preferably, each bottom portion 18 has a deadrise θ that is in the range of approximately 32 to 36 degrees, and, desirably, is about 34 degrees to enhance further the stability of the boat 10 (see e.g. FIG. 2).

Because of the construction of the boat hull structure 12, when the boat 10 reaches high speeds and steps up onto its first strikes 25, the surface on which the boat planes is reduced, thus enabling the boat to achieve high speeds at less horsepower faster than the conventional hulls. At the same time, because of the hulls 14, each with its own first strikes 25, the planing stance of the boat hull structure 12 is wider than that of conventional vee hulls and catamaran hulls, which enhances the handling of the boat, especially at high speeds and in rough waters. The wider planing stance also reduces the likelihood of chine walk.

The dimensions of the hulls 14, the bridging structure 34, the first and second strikes 25, 52, and the U-shaped channels 32 may depend upon the size of the boat, the deadrise of the hulls 14 and the desired performance of the boat 10.

For example, a boat that is 30 feet long may have the following dimensions. The width of each hull 14 at its widest point is in the range of about 3 to 3.5 feet, and the width of the bridging structure 34 is in the range of about 3 to 3.5 feet. The U-shaped channel 32 has a width in the range of about 6 to 8 inches. The horizontal surfaces 40 and 54 have a width of about 2 to 3 inches. The height of walls 30 and the vertical surfaces 42 depend upon several factors, including the deadrise of the hulls.

The boat hull structure 12 may be made of any suitable material, such as, for example, a fiberglass reinforced plastic with a wood or foam core.

The foregoing description is for purposes of illustration only and is not intended to limit the scope of protection accorded this invention. The scope of protection is to be measured by the following claims, which should be interpreted as broadly as the inventive contribution permits.

What is claimed is:

1. A boat hull structure for a boat comprising a pair of laterally-spaced, interconnected hulls extending substantially along the length of the boat hull structure, each hull comprising: a top portion; a bottom portion that defines two hull walls, that has a generally V-shaped cross section substantially along its length, and that is generally symmetrical about a vertical plane extending through its longitudinal axis; a bow having a front end; a stern; inner and outer side walls extending generally upward from the hull walls; a first strike defined on each hull wall and extending along at least most of the length of the hull; and a pair of channel walls extending substantially along the length of the bottom portion to define a channel in the bottom portion into which air and water are forced to provide lift when the boat is moving; the channel being disposed between the first strikes.

2. The boat hull structure of claim 1 wherein the channel walls are spaced, vertical, parallel and generally flat and each channel wall includes an upper end, and wherein each channel is further defined by a base that extends substantially along the length of the hull and interconnects the upper ends of the channel walls, the channel having a rectangular cross section substantially along its length.

3. The boat hull structure of claim 2 wherein each first strike defines a generally horizontal planing surface, and the base of each channel substantially aligns with the horizontal planing surfaces so that the boat can plane on the base and the horizontal planing surfaces at the same time.

4. The boat hull structure of claim 3 wherein each bottom portion further comprises a pair of second strikes upwardly of the first strikes that define second generally horizontal planing surfaces, the channel being disposed between the second strikes.

5. The boat hull structure of claim 4 wherein the second strikes are defined adjacent the inner and outer side walls.

6. The boat hull structure of claim 3 wherein a pair of keel members are defined on either side of the channel by the channel walls on each bottom portion and the portions of the hull walls that extend from the channel walls to the first strikes.

7. The boat hull structure of claim 3 wherein each bottom portion has a deadrise in the range of approximately 32 to 36 degrees.

8. The boat hull structure of claim 3 wherein each bottom portion has a deadrise of approximately 34 degrees.

9. The boat hull structure of claim 3 wherein each channel extends from the stern to the front end of the bow.

10. The boat hull structure of claim 9 wherein each hull gradually narrows at the bow toward the front end, and wherein the first strikes extend from the stern to the bow and terminate at the channel walls rearward of the front end of the bow.

11. The boat hull structure of claim 10 wherein each bottom portion further comprises a pair of second strikes upwardly of the first strikes that define second horizontal planing surfaces, the channel being disposed between the second strikes.

12. The boat hull structure of claim 11 wherein the second strikes extend from the stern to the bow, and terminate at the channel walls rearward of the front end of the bow.

13. The boat hull structure of claim 3 further comprising a bridging structure that interconnects the hulls and extends along at least most of the length of the boat, the bridging structure and inner walls defining a passage that extends along at least most of the length of the boat.

14. The boat hull structure of claim 13 wherein the bridging structure extends from the stern of the boat and terminates rearward of the front end of bow.

15. A boat hull structure for a boat comprising a pair of laterally-spaced, interconnected hulls, each hull comprising: a top portion; a bottom portion that defines two hull walls, that has a generally V-shaped cross section substantially long length, and that is generally symmetrical about a vertical plane extending through its longitudinal axis; a bow having a front end; a stern; inner and outer side walls extending generally upward from the hull walls of the bottom portion; a first strike defined in each hull wall extending along at least most of the length of the bottom portion, each strike defining a first generally horizontal planing surface; a pair of spaced, parallel, generally vertical channel walls extending substantially along the length of the hull and including upper ends; and a base that extends substantially along the length of the hull and interconnects the upper ends of the vertical channel walls, the base substantially aligning with the horizontal planing surfaces so that the boat can plane on the base and the horizontal planing surfaces at the same time; the vertical channel walls and base defining a channel in the bottom portion into which air and water are forced to provide lift when the boat is moving; the channel having a rectangular cross section substantially along its length and being disposed between the first strikes.

16. The boat hull structure of claim 15 wherein each bottom portion further comprises a pair of second strikes upwardly of the first strikes that define second generally horizontal planing surfaces, the channel being disposed between the second strikes.

17. The boat hull structure of claim 16 wherein each bottom portion has a deadrise in the range of approximately 32 to 36 degrees.

18. The boat hull structure of claim 16 wherein each bottom portion has a deadrise of approximately 34 degrees.

19. A boat hull structure for a boat comprising a pair of laterally-spaced, interconnected hulls, each hull comprising: a top-portion; a bottom portion that defines two hull walls, that has a generally V-shaped cross section substantially along its length, and that is generally symmetrical about a vertical plane extending through its longitudinal axis; a bow having a front end; a stern; inner and outer side walls extending generally upward from the hull walls; a first strike defined on each hull wall and extending along at least most of the length of the hull; and a pair of channel walls extending substantially along the length of the bottom portion to define a channel in the bottom portion into which air and water are forced to provide lift when the boat is moving; the channel being disposed between the first strikes; wherein each bottom portion has a deadrise in the range of approximately 32 to 36 degrees;

wherein the channel walls are spaced, vertical, parallel and generally flat and each channel wall includes an upper end, and wherein each channel is further defined by a base that extends substantially along the length of the hull and interconnects the upper ends of the channel walls, the channel having a rectangular cross section substantially along its length; and wherein each first strike defines a generally horizontal planing surface, and the base of each channel substantially aligns with the horizontal planing surfaces so that the boat can plane on the base and the horizontal planing surfaces at the same time.

20. The boat hull structure of claim 19 wherein the deadrise of each bottom portion is approximately 34 degrees.

21. A boat hull structure for a boat comprising a pair of laterally-spaced, interconnected hulls, each hull comprising: a top portion; a bottom portion that defines two hull walls, that has a generally V-shaped cross section substantially long length, and that is generally symmetrical about a vertical plane extending through its longitudinal axis; a bow having a front end; a stern; inner and outer side walls extending generally upward from the hull walls of the bottom portion; a first strike defined in each hull wall extending along at least most of the length of the bottom portion, each strike defining a first generally horizontal planing surface; a pair of spaced, parallel, generally vertical channel walls extending substantially along the length of the hull and including upper ends; and a base that extends substantially along the length of the hull and interconnects the upper ends of the vertical channel walls, the base substantially aligning with the horizontal planing surfaces so that the boat can plane on the base and the horizontal planing surfaces at the same time; the vertical channel walls and base defining a channel in the bottom portion into which air and water are forced to provide lift when the boat is moving; the channel having a rectangular cross section substantially along its length and being disposed between the first strikes;

wherein each bottom portion further comprises a pair of second strikes upwardly of the first strikes that define second generally horizontal planing surfaces, the channel being disposed between the second strikes; and wherein each bottom portion has a deadrise in the range of approximately 32 to 36 degrees.

22. The boat hull structure of claim 21 wherein the deadrise of each bottom portion is approximately 34 degrees.

* * * * *